US005480125A

United States Patent [19]

Bitsch et al.

[11] Patent Number: 5,480,125

[45] Date of Patent: Jan. 2, 1996

[54] HOIST WITH A LIFTING DEVICE

[75] Inventors: Harald Bitsch, Witten; Heinz Hasselmann, Hagen; Johannes Kluge; Wolfgang Krebs, both of Wetter; Uwe Lichtenvort, Essen; Anton Münzebrock, Dortmund; Günter Somborn, Hagen, all of Germany

[73] Assignee: Mannesmann Aktiengesellschaft, Düsseldorf, Germany

[21] Appl. No.: 116,325

[22] Filed: Sep. 3, 1993

[30] Foreign Application Priority Data

Sep. 3, 1992 [DE] Germany ..... 42 29 673.0

[51] Int. Cl.[6] ..... B66D 1/00; B66D 1/12; H01H 19/04

[52] U.S. Cl. ..... 254/264; 254/362; 200/298

[58] Field of Search ..... 254/360, 361, 254/362, 270, 372, 264; 200/298, 331, 332

[56] References Cited

U.S. PATENT DOCUMENTS

| | | | |
|---|---|---|---|
| 2,408,502 | 10/1946 | Writzmann | 200/298 X |
| 2,750,480 | 6/1956 | Freeman | 200/298 X |
| 2,801,760 | 8/1957 | Christofferson | 254/362 X |
| 2,989,288 | 6/1961 | Smith | 254/360 X |
| 3,858,845 | 1/1975 | Grote et al. | 254/266 |
| 3,921,959 | 11/1975 | Ulbing | 254/270 |
| 4,026,526 | 5/1977 | Messerschmidt et al. | 254/264 |
| 4,789,135 | 12/1988 | Watanabe | 254/362 |
| 4,844,421 | 7/1989 | Kajima | 254/362 X |
| 4,917,360 | 4/1990 | Kajima | 254/362 |

FOREIGN PATENT DOCUMENTS

| | | | |
|---|---|---|---|
| 2513031 | 10/1976 | Germany | 254/362 |
| 0211438 | 3/1967 | Sweden | 254/362 |

*Primary Examiner*—Daniel P. Stodola
*Assistant Examiner*—Michael R. Mansen
*Attorney, Agent, or Firm*—Cohen, Pontani, Lieberman, Pavane

[57] ABSTRACT

A hoist with a lifting device, by way of which a load suspension device connected with the lifting device via a traction mechanism can be raised and lowered, and with a control device which is arranged between the load suspension device and the traction mechanism and includes a housing with a handle for manipulating the load suspension device. Switching members are arranged in the housing for controlling the lifting device, and a high-strength connecting member is fastened in the housing, with the traction mechanism and the load suspension device being fastened to the connecting member. The housing is divided into a mechanical part with the handle for receiving an actuating mechanism for the switching members and into an electrical part for receiving the switching members with the connecting member being arranged between the mechanical part and the electrical part.

12 Claims, 4 Drawing Sheets

Fig.4
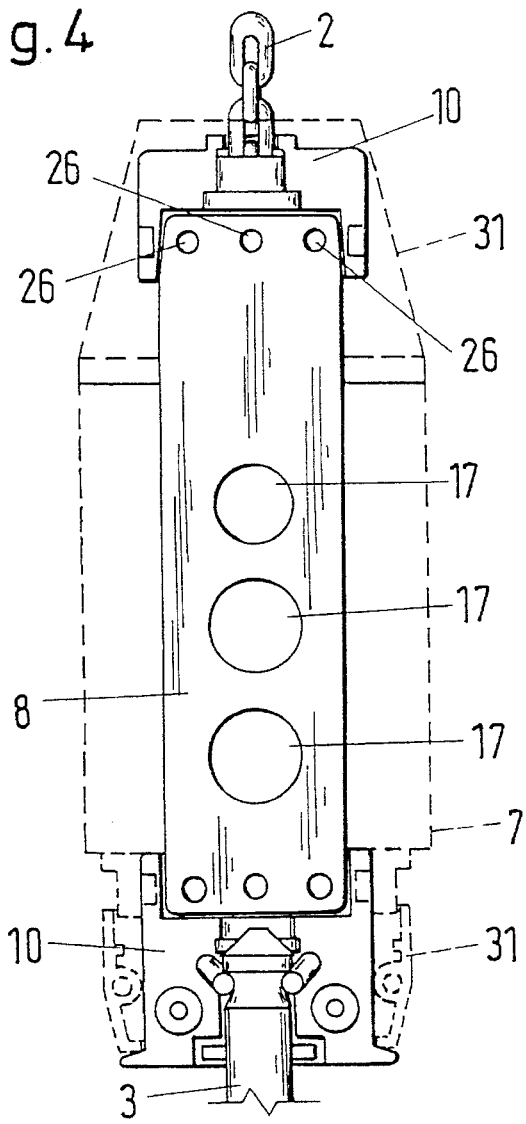
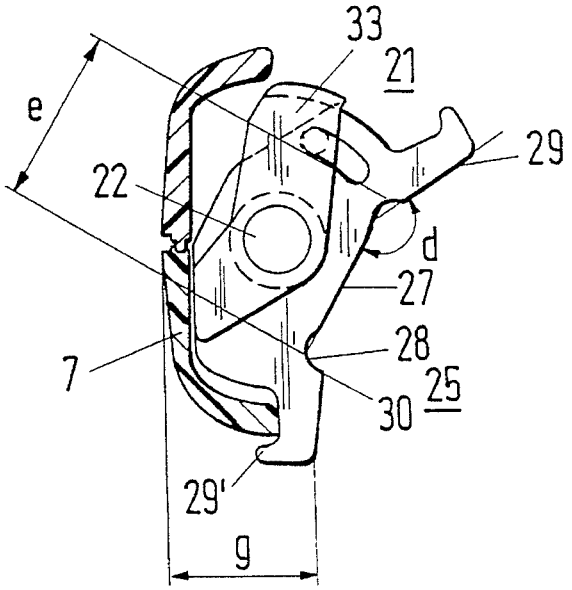
Fig.5

HOIST WITH A LIFTING DEVICE

BACKGROUND OF THE INVENTION

1. Field of the Invention

The invention is directed to a hoist with a lifting device by means of which a local suspension device connected with the lifting device via a traction mechanism can be raised and lowered.

2. Description of the Prior Art

Such a hoist with a lifting device is known from DE 25 13 031 C2. The lifting device is connected with a traction mechanism which can be wound up and wound off by the lifting device, a control device being arranged at the free end of the traction mechanism. A load suspension device is fastened to the control device. The control device has a housing to which is fastened a straight, horizontally arranged gripping piece for manipulating the load suspended from the load suspension device. Switching members for controlling the lifting device are arranged in the housing and can be acted upon via switches arranged at the housing. A person grasping the handle can reach the switches with his thumb without having to release the handle. Moreover, a stirrup of high-strength material, e.g. steel, is arranged in the housing. The traction mechanism acts at the upper end of the stirrup and the load suspension device is fastened to the lower end.

This stirrup is constructed as a rectangular frame so as to provide sufficient installation space for the switches inside the housing.

This construction of the housing with the stirrup has proven advantageous for a multitude of uses, but there is a high technical cost involved in providing a moisture-proof sealing of the housing which is divided into an upper part and a lower part. However, this sealing is absolutely necessary for a housing used as an installation space for electrical switching members. A further disadvantage is that undesirable bending moments occur due to the deflection of the flow of forces in the rectangular stirrup when the hoist, particularly the control device, is loaded with greater loads.

SUMMARY OF THE INVENTION

Accordingly, it is an object of the present invention to provide a hoist with a lifting device and a control device acting on the load suspension device which has a reliable sealing of the switching members arranged in the control device against environmental influences such as moisture and dust.

Pursuant to this object, and others which will become apparent hereafter, one aspect of the present invention resides in a hoist of the generic type having a lifting device and a control device arranged at a load suspension device. The control device including a housing that is divided into a mechanical part having a handle for receiving an actuating mechanism for the switching numbers within the housing, and into an electrical part that holds the switching members. A high-strength connecting member being arranged between the mechanical and electrical parts of the housing.

By dividing the housing of the control device into a mechanical part and an electrical part in the hoist, the sealing of the electrical part against outer influences is fundamentally facilitated according to the present invention. A particularly compact construction of the control device is made possible by at least partially integrating the connecting member into the dividing wall. As a result of the arrangement of the connecting member in a horizontal position—when the housing is considered as suspended from the traction mechanism—and its construction as a flat sheet-steel strip, the load acting on the load suspension device is guided without moments through the housing to the traction mechanism which is particularly constructed as a chain. Accordingly, a definite correspondence is achieved between the load-supporting function of the control device and the sheet-steel strips.

On the other hand, the housing with the handle has the object of protecting the switching members and the actuating mechanism while transmitting the manual forces of the operator to the connecting member. The housing is made by plastic injection molding. The construction of the connecting member as a sheet-steel strip for conducting the load has proven to be optimal. The load range of the hoist according to the invention is expanded to approximately 250 kg due to the direct flow of force. Beyond this, of course, the housing also serves to transmit the handling forces of the operator who acts on the connecting member, and accordingly on the load, via the handle and the housing. It is particularly advantageous to provide the connecting member and the dividing wall with bore holes in order to guide the switching tappets of the switching members out of the electrical part into the mechanical part of the control device. Accordingly, the switching tappets can be sealed in a particularly simple manner. For example, this sealing can be effected via hat-shaped sealing members which are slipped over the switching tappets, their open ends being tightly connected with the defining edges of the bore holes in a postive enagement.

The vertically divided construction of the electrical part of the housing is also particularly advantageous, since the switching members are exposed enough after the removal of the container-like cover to enable a simple connection of the switching contacts with the leads.

The horizontal division of the mechanical part of the housing at the height of the center of the handle as well as an additional vertical division of the upper, mechanical part in front of and immediately adjacent to the dividing wall and the connecting means is also particularly advantageous. Accordingly, after the upper housing part is removed, the actuating mechanism for the switching members is especially easy to access. Moreover, since the lower mechanical housing part including the lower half of the housing and the front electrical part form an L-shaped housing unit as seen from the side, which L-shaped housing unit encloses the connecting member in a positive-locking engagement, it is ensured that the handling forces of the operator transmitted to the handle are reliably transferred to the connecting member and accordingly to the load suspension device.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

BRIEF DESCRIPTION OF THE DRAWING

FIG. 4 shows a front view of a connecting member with connection pieces for a traction mechanism and a load suspension device; and FIG. 5 shows a switching rocker according to section line V—V in FIG. 3.

DETAILED DESCRIPTION OF THE PREFERRED EMBODIMENTS

Figure 1:
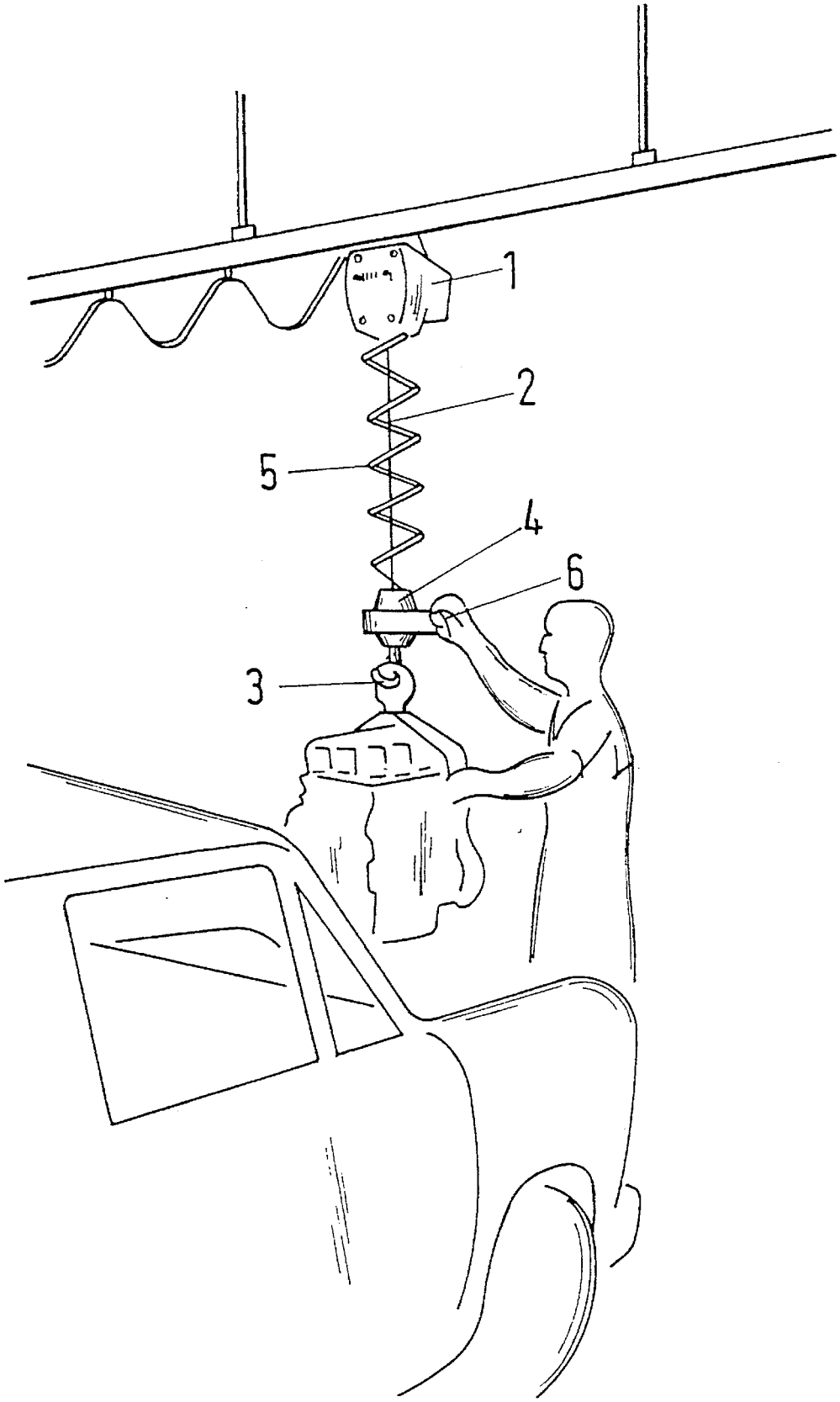
FIG. 1 shows a hoist pursuant to the present invention with a lifting device and a control device arranged at the traction mechanism during the lowering of an engine into a passenger automobile.

FIG. 1 shows a hoist with a lifting device 1 which can be moved horizontally at a rail. The lifting device 1 serves to raise and lower a load suspension device 3 which is constructed as a hook and is connected with the lifting device 1 via a traction mechanism 2. A control device 4 is arranged between the load suspension device 3 and the end of the traction mechanism 2. The control device 4 contains switching members, not shown, which serve to switch the lifting device 1 via a control line 5 which is guided in a helical manner around the traction mechanism 2. Moreover, the control device 4 has a handle 6 which is arranged horizontally and on the front side of a housing when the control device 4 is considered as vertically suspended at the traction mechanism. The handle 6 is used by an operator for manual guidance of the load suspended at the control device 4 via the load suspension device 3.

Figure 2:
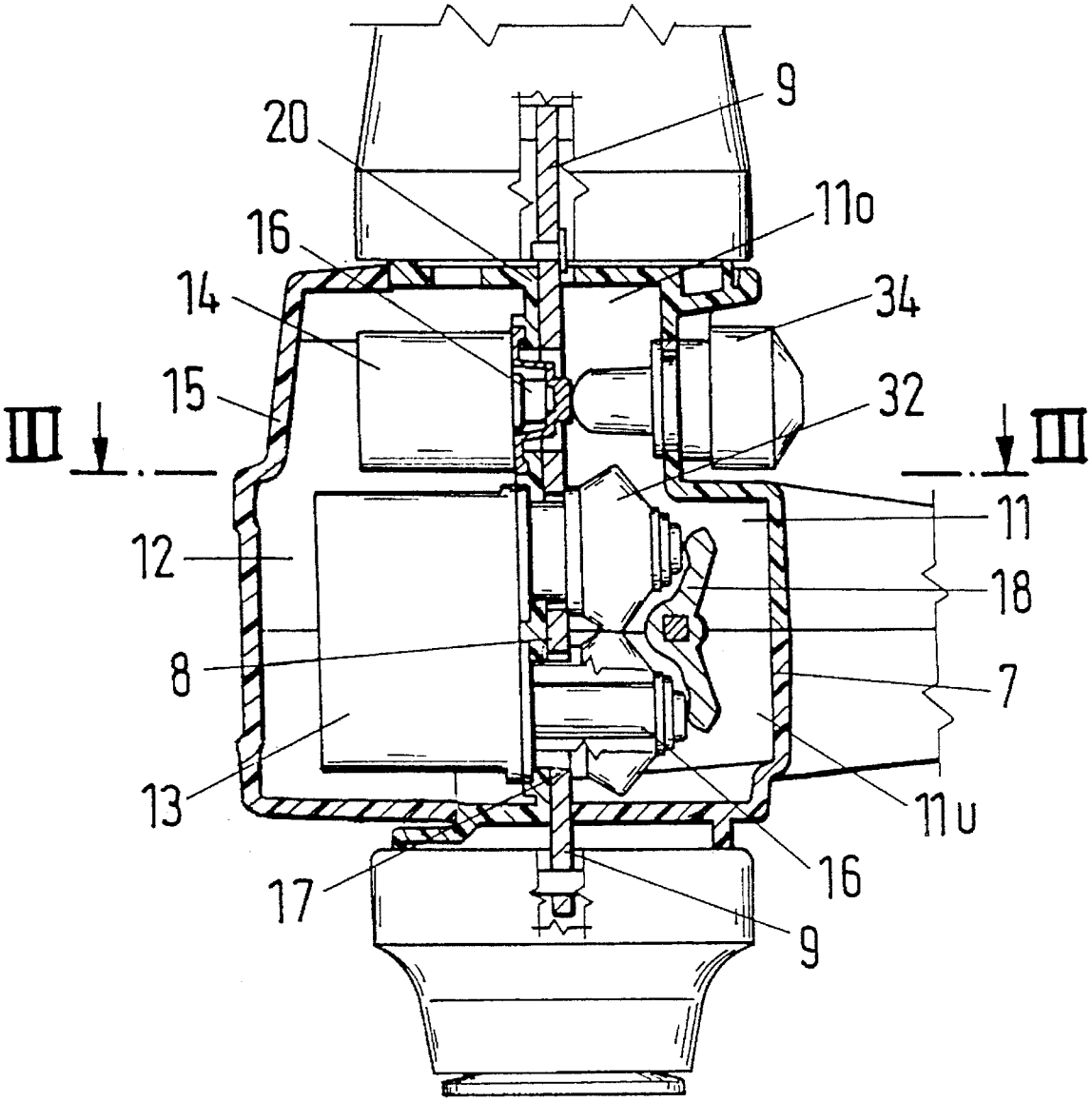
FIG. 2 shows a longitudinal section through the control device.

FIG. 2 shows a longitudinal section through a control device 4 according to the invention showing part of the handle 6. It can be seen that the control device 4 substantially comprises a housing 7 and a connecting member 8 which is constructed in particular as a sheet-steel strip. The connecting member 8 extends in the longitudinal direction through the entire housing 7 and projects out of the housing 7 at the top and at the bottom when the control device 4 is viewed as suspended at the traction mechanism 2. FIG. 2 also shows that the connecting member 8 and a dividing wall 20 divide the interior of the housing 7 into a mechanical part 11 and an electrical part 12 along the longitudinal dimension of the handle 6 and parallel thereto. The switching members 13 for controlling the lifting device 1 are designed particularly as push snap-switches and are arranged in the electrical part 12 along with an emergency-stop switching member 14. The switching members 13, 14 which are arranged one above the other are enclosed by side walls 19, by the dividing wall 20 of the housing 7, and by the connecting member 8 in the manner of a container. The electrical part 12 of the housing 7 which is open toward the outside is closed in a water-tight and dust-tight manner by a cover 15 which is also constructed in the manner of a container. When the cover 15 is removed, the switching members 13, 14 project out toward the back over the side walls 19 of the housing 7.

The mechanical part 11 of the housing 7 serves to receive the switching tappets 16 of the switching members 13, 14, which switching tappets 16 are guided through bore holes 17 in the connecting member 8 and the dividing wall 20. The mechanical part also receives the actuating mechanism for the transmission of switching forces proceeding from the outside to switching rockers, not shown, arranged at the housing 7 to a two-armed lever 18 which is supported on a lever shaft 24 and can actuate the two switching tappets 16 of the switching member 13. The switching tappet 16 of the emergency-stop switching member 14 can be actuated via a push button 34 which is arranged in the housing wall on the front side of the mechanical part 11 above the handle 6. The switching tappets 16 are enclosed within the mechanical part 11 by sealing members 32 which are constructed as rubber diaphragms and close tightly with the bore holes 17. The sealing members 32 are hat-shaped and are provided with a circumferentially extending kink or notch in their side wall to enable an intentional collapsing of the sealing member 32 when the switching tappet 16 is actuated. FIG. 2 also shows that the mechanical part 11 of the housing 7 is divided horizontally into an upper part **11*o* and a lower part 11*u* at the height of the lever shaft 24 which is situated at the same height as the center of the handle 6**.

The upper part **11*o* also has a dividing plane which extends vertically and parallel to the connecting member 8 so that when the upper part 11*o* is removed the electrical part 12 and the lower part 11*u* of the housing are L-shaped as viewed from the side and the upper part 11*o*** is consequently angular.

Figure 3:
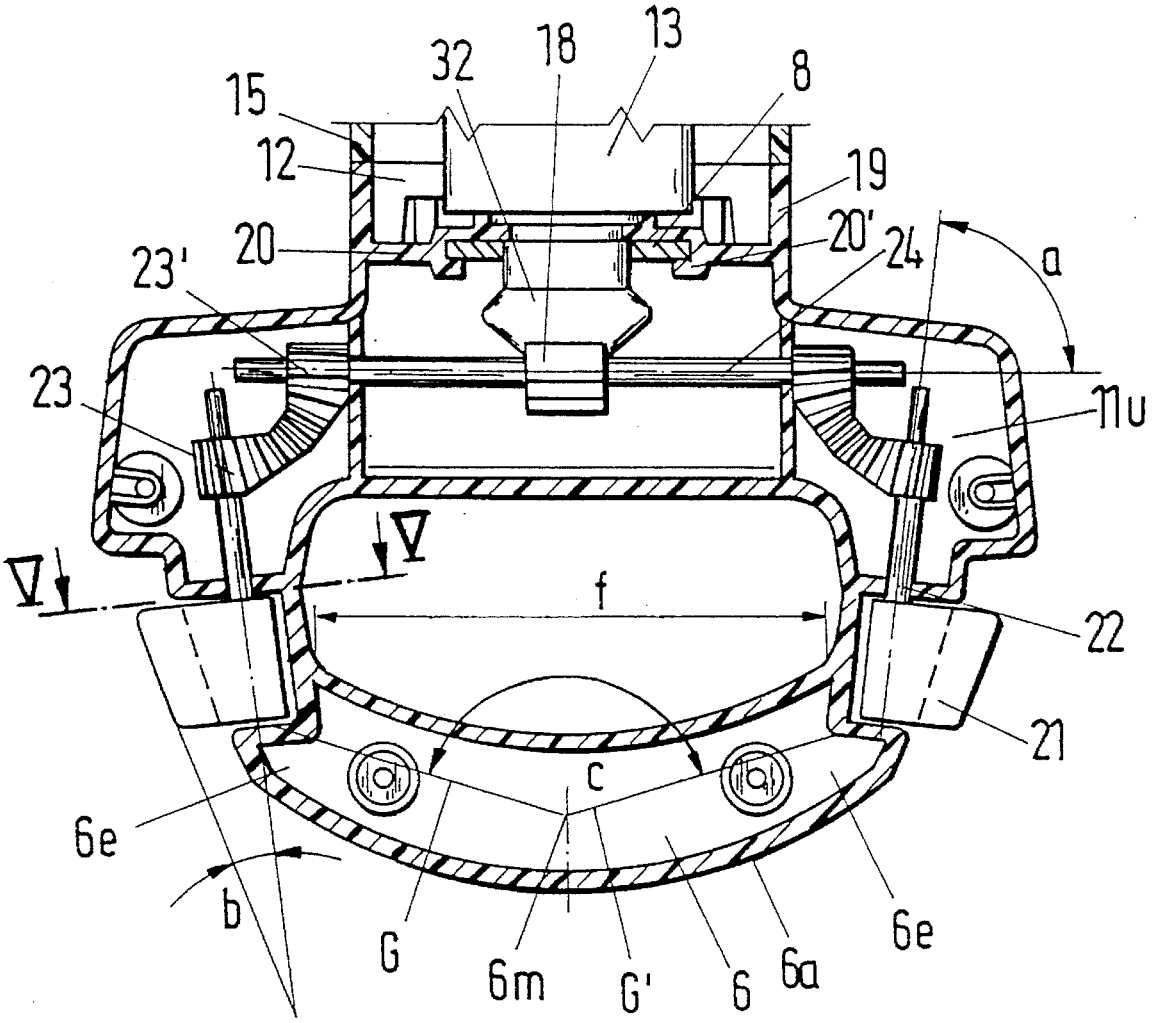
FIG. 3 shows a cross section through the control device according to section line III—III in FIG. 2.

FIG. 3 shows a cross section through the control device 4 according to the invention with the omission of the upper part **11*o* of the housing 7 according to section line III—III in FIG. 2. This figure clearly shows that the electrical part 12 of the housing 7 is defined by the side wall 19 of the housing 7, the connecting member 8, the dividing wall 20, and the cover 15. The container-shaped electrical part 12 of the housing 7 is formed by side walls 19 and the base is formed by the connecting member 8 and the dividing wall 20. The connecting member 8 extends parallel to and adjacent to the dividing wall 20 and is gripped at its lateral edges by webs 20'. The webs 20' are fastened to the dividing wall 20 and accordingly form a connection between the housing 7 and the connecting member 8 supported by the housing 7**.

FIG. 3 also shows the construction of the mechanical part 11 of the housing 7. The housing 7 of the mechanical part 11 essentially has the shape of an oval ring at the height of the handle 6. The handle 6, which is a structural component part of the mechanical part 11 of the housing 7, is located at a longitudinal side of the oval. The mechanical part 11 of the housing 7 assumes a square shape on the side located opposite the handle 6 and merges toward the rear with the likewise square electrical part 12 of the housing 7. A switching rocker 21 which is swivelable around horizontal rocker shafts 22 supported in the housing 7 is arranged in the area of each of the two ends of the curved handle 6. The ends of the rocker shafts 22 remote from the switching rockers 21 are provided with toothed-wheel segments 23 which mesh with other toothed-wheel segments 23'. The toothed- wheel segments 23' are arranged at the ends of a common lever shaft 24 whose longitudinal dimension is directed parallel to the width of the housing 7. The two-armed lever 18 is slid into the center of the horizontal lever shaft 24 and serves to actuate the switching tappets 16 of switching members 13 via its ends.

The rocker shafts 22 and the lever shaft 24 are arranged at an angle a relative to one another. The angle a is approximately 70° to 85°, particularly 83°. This causes an inclination of the rocker shaft 22 in the direction of the center **6*m* of the handle 6. This inclination continues in the supporting surface 25 for the actuating thumb of the operator at the switching rocker 21, since this supporting surface 25 is inclined at an angle b of approximately 10° to 20°, particularly 15°, to the axis of the rocker shaft 22. The central region 27 of the supporting surface 25—shown in dash-dot lines—(see also FIG. 5) merges smoothly into the outside 6*a* of the handle to prevent an uncomfortable edge for the actuating thumb. In order to achieve this balance between the central region 27 and the outside 6*a* of the handle, the angle between the rocker shaft 22 and the central region 27** is somewhat smaller than the angle b, i.e. between 5° and 15°, particularly 10°.

The handle 6 is shaped as a ring segment which is curved in a convex manner as seen from the electrical part 12 of the housing. The curvature of the handle 6 is selected in such a way that the outside 6*a* of the handle 6 intersects the supporting surface 25 of the switching rocker 21 in an imaginary prolongation of the curvature. The curvature of the handle 6 and the angular position of the supporting surface 25 are directed toward one another so that the transition from the handle 6 to the supporting surface 25 is as smooth as possible and accordingly ensures an ergonomic attitude of the hand, particularly the thumb. Moreover, the handle 6 is constructed so as to be symmetrical to an imaginary plane extending vertically and transversely through the center 6*m* of the handle 6. To assist in describing the curvature of the handle 6, two straight lines G may be drawn; the angle c enclosed by these straight lines G serves as a measurement for the curvature of the handle. The straight lines G start in the center 6*m* of the handle as seen in the transverse and longitudinal directions and extend through the center of the ends 6*e* of the handle as seen in the transverse direction. The enclosed angle c is between 150° and 170°, particularly 160°. The width f of the handle 6 is 100 to 110 mm, particularly 105 mm.

FIG. 4 shows a front view of the connecting member 8 which is constructed in particular as a steel plate. The connecting member 8 is shaped like a strip and is provided on its flat side and in its center with three bore holes 17 arranged at a distance from one another in the longitudinal direction. The switching tappets 16 are guided through these bore holes 17. Two additional fastening bore holes 26 are arranged at the ends of the connecting member 8. Positive-locking pins which are structural component parts of one half of the longitudinally divided connection pieces 10 are inserted into these fastening bore holes 26. Another bore hole 26' arranged between the fastening bore holes 26 serves to receive a screw, not shown, for connecting the longitudinally divided connection pieces 10 with the connecting member 8. The lower connection piece 10 is connected with a load suspension device 3, whose stud or pin is shown in part. The upper connection piece 10 serves to fasten the traction mechanism 2 to the connecting member 8. The connection pieces 10 and the ends 9 of the connecting member 8 projecting out of the housing 7 at the top and bottom are covered by caps 31. The lower cap 31 is vertically displaceable so that the pin for fastening the load suspension device 3 can be unlocked.

FIG. 5 shows a section from the area of the switching rocker 21 according to section line V—V in FIG. 3, wherein the switching rocker 21 is actuated downward and the upper part 11*o* of the housing 7 is included. As to its function, the switching rocker 21 is comparable to a two-armed lever and has a central bore hole for receiving the rocker shaft 22 so that the lever arms have the same length.

On the side remote of the housing 7 and projecting out of the housing 7, the switching rocker 21 has a supporting surface 25 for the thumb of the actuating hand, this supporting surface 25 being inclined in the direction of the rocker shaft 22. The supporting surface 25 is divided into a central region 27, a transition region 28, and an edge region 29. The central region 27 of the supporting surface 25 is arranged opposite the rocker shaft 21 so that the lever arms are very short. Furthermore, the central region 27 is curved in a slightly convex manner as viewed externally. The central region 27 serves to receive the actuating thumb in the neutral position and has a width e of 15 to 22 mm, particularly 20 mm, directed transversely to the rocker shaft 22. In the neutral position of the switching rocker 21, the central region 27 is aligned vertically.

Adjoining the central region 27 at the top and bottom are transition regions 28 of small radius which then pass from the central region 27 into a perceptible edge 30 in the edge region 29. The edge regions 29 and the central region 27 are arranged at an angle d of 25 to 35°, particularly 28°, relative to one another. The free ends of the edge region 29 have a projection 29' on the side remote from the actuating surface 25, so that the edge region 29, as a whole, has a hook-shaped construction when viewed from the side. The length of the switching rocker 21 is selected so that the edge region 29 projects out over the contour of the housing 7 at the top and bottom when the actuated edge region 29 abuts at the housing 7. In so doing, the projection 29' is directed toward the wall of the housing. Another important dimension is the distance g between the inside of the handle end 6*e* and the edge region 29 of an actuated switching rocker 25. This distance g assumes values of 15 to 25 mm, particularly 21 mm, and accordingly determines the distance between the surface of the thumb and the lateral surface of the index finger. The selected values allow a forceful actuation of the switching rocker 25, but one which is not fatiguing. Moreover, it can be seen that a flap 33 is guided on a round projection of the switching rocker 21. A driver swivels the flap 33 along with the switching rocker 21 when the latter is actuated and the flap 33 accordingly closes a gap occurring between the housing 7 and the end of the switching rocker 21 which is not actuated.

The invention is not limited by the embodiments described above which are presented as examples only but can be modified in various ways within the scope of protection defined by the appended patent claims.

We claim:

1. A hoist, comprising: load suspension means; lifting means for raising and lowering the load suspension means; a traction mechanism connecting the suspension means with the lifting means; and control means for the lifting means and the load suspension means, the control means being arranged between the load suspension means and the traction mechanism and including a housing with a handle for manipulating the load suspension means, switching members arranged in the housing for controlling the lifting means, actuating means being arranged in the handle for actuating the switching members, and a high-strength connecting member fastened in the housing, the traction mechanism and the load suspension means being fastened to the connecting member, the housing being divided into a first, mechanical part which is provided with the handle and into a second, electrical part that receives the switching members, the connecting member being arranged between the mechanical part and the electrical part, a dividing wall being a structural component part of the housing and extending parallel to and adjacent with the connecting member; and inwardly projecting webs being a structural component part of the housing that enclose the connecting member on a side remote from the dividing wall and fasten the connecting member to the housing.

2. A hoist according to claim 1, wherein the connecting member is arranged vertically in the housing when the housing is viewed as suspended from the traction mechanism.

3. A hoist according to claim 1, wherein the connecting member is a flat sheet-steel strip.

4. A hoist according to claim 1, wherein the switching members have switching tappets, the connecting member and the dividing wall having bore holes through which the switching tappets of the switching members are guided from the electrical part into the mechanical part.

5. A hoist according to claim 4 and further comprising hat-shaped sealing members provided so as to respectively enclose the switching tappets, the hat-shaped sealing members each having an end arranged tightly in a respective one of the holes.

6. A hoist according to claim 1, wherein the switching members having switching tappets, the connecting member has bore holes through which the switching tappets of the switching members are guided from the electrical part into the mechanical part.

7. A hoist according to claim 6, and further comprising hat-shaped sealing members provided so as to respectively enclose the switching tappets, the hat-shaped sealing members each having an end arranged tightly in a respective one of the holes.

8. A hoist according to claim 1, wherein the electrical part of the housing is divided vertically into a container-like cover having a base arranged opposite the connecting member, and into a container-like portion defined by side walls and the connecting member.

9. A hoist according to claim 1, wherein the handle is horizontal and arranged on the mechanical part of the housing so as to be remote from the electrical part, the mechanical part being divided horizontally into an upper part and a lower part, the upper part having a dividing plane relative to the electrical part that extends parallel to the connecting member.

10. A hoist according to claim 1, wherein the housing has a top and a bottom when viewed as suspended from the traction mechanism, the connecting member being arranged in the housing so as to have ends that project out of the housing at the bottom and at the top, and further comprising a first connecting piece that connects the end of the connecting member projecting from the top of the housing to the traction mechanism, and a second connecting piece for connecting the end of the connecting member projecting from the bottom of the housing to the load suspension means.

11. A hoist according to claim 1, wherein the housing is a plastic injection molded part.

12. A hoist according to claim 1, wherein the load suspension means includes a hook.

* * * * *